United States Patent [19]

Rosenberg et al.

[11] 4,379,424

[45] Apr. 12, 1983

[54] DEVICES FOR LIMITING THE STROKE OF A HYDRAULIC RAM USED IN MINING APPARATUS

[75] Inventors: Harry Rosenberg, Lüdinghausen; Karl-Heinz Plester, Lunen; Friedrich Eggenstein, Bergkamen-Oberaden; Günter Terhorst, Dülmen, all of Fed. Rep. of Germany

[73] Assignee: Gewerkschaft Eisenhutte Westfalia, Lunen, Fed. Rep. of Germany

[21] Appl. No.: 158,628

[22] Filed: Jun. 11, 1980

[30] Foreign Application Priority Data

Jun. 16, 1979 [DE] Fed. Rep. of Germany ..... 2924380

[51] Int. Cl.[3] ..... F15B 15/24

[52] U.S. Cl. ..... 92/13.41; 403/3

[58] Field of Search ..... 92/13.4, 13.41; 74/586; 403/3, 4

[56] References Cited

U.S. PATENT DOCUMENTS

| | | | |
|---|---|---|---|
| 2,442,306 | 5/1948 | McCormick | 92/13.44 |
| 3,857,246 | 12/1974 | Roenspies et al. | 92/13.4 |
| 4,177,681 | 12/1979 | Wess | 92/13.41 |

*Primary Examiner*—Martin P. Schwadron
*Assistant Examiner*—Richard L. Klein
*Attorney, Agent, or Firm*—Thompson, Birch, Gauthier & Samuels

[57] ABSTRACT

A device for limiting the stroke of a hydraulic ram of mining apparatus employs a segmental stop which partly surrounds the piston rod of the ram. The stop locates between the cylinder of the ram and a head piece at the end of the piston rod. The cylinder of the ram makes contact with the stop during retraction of the ram thereby limiting the stroke of the ram. The stop is connected to the head piece via replaceable or adjustable pins. These pins permit the distance between the head piece and the stop element to be altered at will. The connection pins also enable the stop to be arranged to partly surround the piston rod periphery over different regions thereof.

13 Claims, 6 Drawing Figures

DEVICES FOR LIMITING THE STROKE OF A HYDRAULIC RAM USED IN MINING APPARATUS

BACKGROUND TO THE INVENTION

The present invention relates in general to mineral mining apparatus and more particularly to a device for limiting or controlling the stroke of a hydraulic ram used in such apparatus.

It is known to employ, in a mineral mining installation, hydraulic shifting rams which connect movable roof supports to a scraper-chain conveyor arranged alongside a mineral face. These rams are extended and retracted alternately from time-to-time to thrust and shift the conveyor forwardly towards the mineral face and to draw up the roof supports to follow this shifting progress. In most cases, the shifting rams are extended and retracted by their full working stroke but under certain conditions it may be necessary to displace the conveyor section or the roof support associated with a ram by a distance somewhat less than the full working stroke of the ram. Use can then be made of a device which serves to limit the stroke of the ram to a distance less than its full stroke. Examples of known types of devices are described in German Pat. Nos. 1226972, 1801564, 2220452 and 2651398. Generally speaking, known stroke limiting devices all have some form of stop physically located between the cylinder of the ram and a head at the end of its piston rod but suffer from certain disadvantages.

A general object of this invention is to provide an improved stroke-limiting device.

SUMMARY OF THE INVENTION

In accordance with the invention, a device for limiting or controlling the stroke of a hydraulic ram employs a stop or stop member which locates in the space between the cylinder of the ram and a head piece at the end of the piston rod thereof and only partly surrounds the piston rod itself. This enables the stop member to be arranged in the most favorable position to suit the restricted space available in the underground mine workings in which the ram is installed. In addition, the stop member can be rearranged from time-to-time to avoid briquetting of fine material e.g. where the ram is a shifting ram connected between a roof support and a conveyor in a coal mine working.

In a preferred embodiment of the invention, the stop member extends around a part of the periphery of the piston rod which corresponds to an angle of approximately 180° to 220°. Preferably the stop member is mounted so that it can be removed and installed easily in the cramped condition in the mine working. The stop member can be connected to the head piece of the piston rod via connecting means allowing a pre-determined spacing between the stop member and the head piece. The connecting means, or at least one component thereof, preferably similarly only partly surrounds the piston rod. The connection between the stop member and the head piece preferably enables the distance between the stop member and the head piece to the adjusted or altered, e.g in situ or by interchangeability. In addition, the connecting means may serve to connect the stop member to the head piece in selected positions with the stop member partly surrounding the piston rod over different regions of the periphery thereof.

The stop member and the head piece can be provided with recesses or apertures receiving the connection component or components. In one embodiment of the invention, described hereinafter, the connection between the stop member and the head piece of the piston rod is established by means of a plurality of rods or pins. It is preferred to make the rods or pins from spring steel. These pins connect and space the stop member and the head piece and are located at equal angular spacing dispositions around a common pitch circle with its centre at the axis of the piston rod. Three such pins can be provided, for example, offset by 90° from one another. The pins are detachably and/or adjustably connected to the piston rod head piece and/or the stop member. Screws, pins or clamp sleeves, for example, can be used to fix the pins to the head piece and the stop member. The head piece can be provided with bores, which may be blind bores, or open recesses which serve to receive the pins. A similar provision can be made on the stop member. To allow the stop member to be located in different positions it is convenient to provide a greater number of bores or apertures for receiving the pins on the head piece than there are pins themselves.

In one preferred embodiment, described hereinafter, both the head piece and the stop member receive the pins in bores which are accessible from the exterior via transverse holes and possibly recesses as well. The connection pins are then provided with transverse holes which can be aligned with the transverse holes in the stop member and the head piece to receive clamping elements such as sleeves or the like. This permits sets of connection pins of different length to be employed thereby to alter the stroke limitation distance by their interchangement.

In another construction, the connection pins are provided with grooves spaced apart along their lengths. These grooves then receive locking members to secure the head piece and the stop member to the pins at variable spacing thereby again altering the stroke limitation distance.

The invention may be understood more readily, and various other features and aspects of the invention may become apparent, from consideration of the following description.

BRIEF DESCRIPTION OF DRAWINGS

Embodiments of the invention will now be described with reference to the accompanying drawings, wherein.

DESCRIPTION OF PREFERRED EMBODIMENTS

Figure 1:
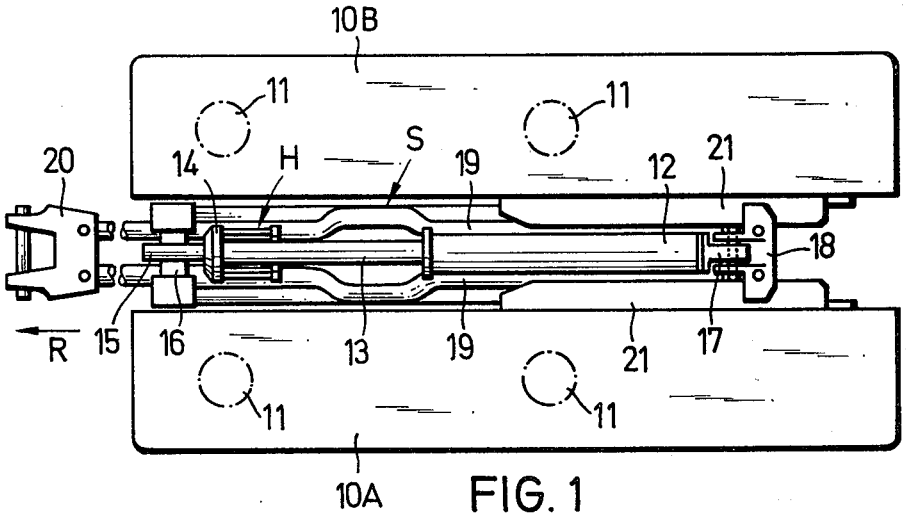
FIG. 1, is a schematic plan view of the floor sill structure of a mine roof support employing a shifting control device constructed in accordance with the invention.
Figure 2:
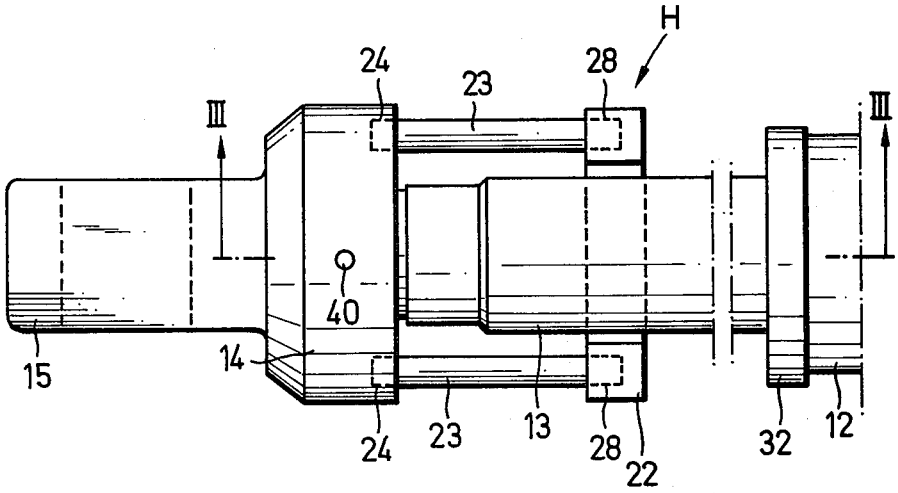
FIG. 2, is an enlarged plan view of the device shown in FIG. 1.

FIG. 1 of the accompanying drawings depicts the floor sill structure of a movable roof support for use in an underground mine working. This floor-engaging structure is composed of a pair of parallel skid members 10A, 10B which support hydraulic props 11 by way of suitable connection joints. The props 11 which are not shown in detail carry a single or multi-part roof engaging structure (not shown). A guide and shifting mechanism S is located between the skid members 10A, 10B. This mechanism S utilizes a double-acting hydraulic ram 12 which has a piston rod 13. The piston rod 13 is provided with a head piece 14 which is coupled via a swivel or toggle joint 15 to a cross bolt 16 which interconnects the front end regions of the skid members 10A, 10B together. The rear end of the cylinder of the ram 12 is likewise provided with a swivel or toggle joint 17 which is articulated to a transverse link 18. The link 18 connects the rear ends of a pair of parallel resilient guide bars 19 together. The guide bars 19 extend alongside the ram 12. The front end regions of the bars 19 project outwardly beyond the skid members 10A, 10B and are interconnected by means of a bracket or coupling 20. This coupling 20 serves to connect the guide bars 19 in articulated fashion to a scraper-chain conveyor (not shown). The transverse link 18 which connects the bars 19 together at the rear locates with guides 21 at the inner sides of the skid members 10A, 10B. When the ram 12 is retracted and the props 11 are set against the roof, the guide bars 19 are displaced in the direction of arrow R and are guided by the guides 21. The bars 19 urge the conveyor forwards towards the mineral face via the coupling 20. The skid members 10A, 10B and the support itself forms an abutment for the shifting ram 12. When the associated section of the conveyor has been thrust forward in this manner, the props 11 can be relieved and the ram 12 extended to draw up the support in the shifting direction R.

In accordance with the invention a device H is provided for limiting and controlling the effective stroke of the ram 12 during these shifting operations. The device H, which is shown in more detail in FIGS. 2 to 5, is connected to the head piece 14 of the piston rod 13 of the ram 12. As shown in FIGS. 2 to 5, the device H is composed of a stop member 22 of part-circular form. This stop element 22 extends around only part of the peripheral exterior surface of the piston rod 13 as shown particularly in FIG. 5. The stop element 22 can cover a region of the piston rod 13 exterior corresponding to an angle of around 180°–220°.

Figure 4:
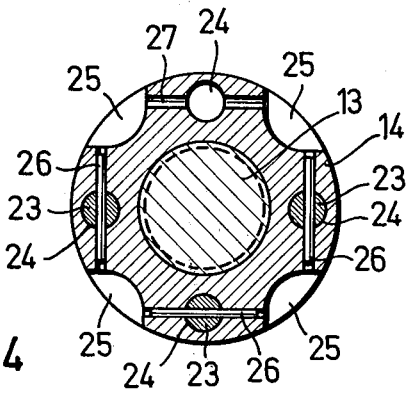
FIG. 4, is a sectional end view of the device of FIG. 2, the view being taken along the line IV—IV of FIG. 3.
Figure 5:
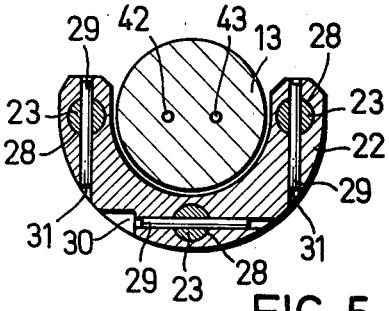
FIG. 5, is a sectional end view of the device of FIG. 2, the view being taken along the line V—V of FIG. 3.

The stop member 22 is connected to the head piece 14 by means of a set of three spacer or connection pins 23. These pins 23 are preferably made from spring steel and are disposed on a common pitch circle described from the axis of the piston rod 13. As shown in FIGS. 4 and 5, the pins 23 may be mutually spaced apart around the circle by a separation angle of 90°. The stop member 22 is provided with bores 28 which receive the pins 23. The head piece 14 itself is provided at the end surface nearest the ram 12 with four blind bores 24 which are disposed on the same pitch circle as the pins 23 and which are mutually spaced by the same angle e.g. 90°, as the pins 23. Thus, the pins 23 can be aligned with any three of the bores 24 and located therein to connect the head piece 14 to the stop member 22 in a desired angular deposition to suit the prevailing conditions. Thus, where the ram 12 is to lie close to the floor of the mine working it would be desirable to invert the stop member 22 from the position shown in FIG. 5 so that the stop 22 is above the piston rod 13.

As shown in FIG. 4, the head piece 14 is provided with recesses 25 in its exterior which lie between the bores 24. Transverse holes 27 extend between the flanks of the recesses 25 to intersect the blind bores 24. Similarly, transverse holes 31 intersect the bores 28 in the stop member 22 and one or more recesses 30 can be provided for better access to the bores 28. The pins 23 themselves have transverse holes in their end regions which can be aligned with the holes 27, 31 to receive clamping pins or sleeves 26, 29 which serve to secure the head piece 14 and the stop member 22 to the pins 23. The pins or sleeves 26, 29 can be driven in or withdrawn from either direction since access is provided at both ends of the holes 27, 31.

The end of the cylinder of the ram 12 nearest the piston rod 13 is fitted with a guide bushing 32 for guiding the motion of the piston rod 13. With the stop member 22 set in position with the pins 23, the retraction of the ram 12 will be limited to a set distance or shifting step when the guide bushing 32 makes contact with the stop member 22. When the ram 12 is subsequently extended its stroke will correspond to the set distance step. A number of sets of pins 23 of different lengths would be provided and by interchanging the pins 23 the effective stroke of the ram 12 can be altered. The interchanging of the pins 23 can be effected fairly easily by removing and replacing the clamping pins or sleeves 26, 29.

Figure 3:
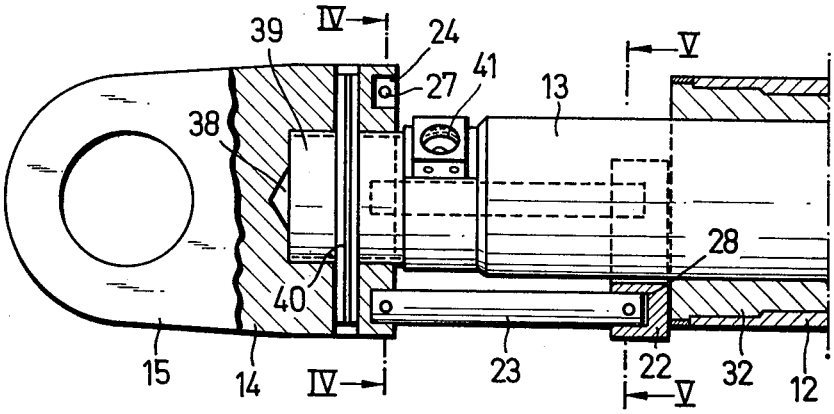
FIG. 3, is a sectional side view of the device of FIG. 2, the view being taken along the line III—III of FIG. 2.

Hydraulic connectors for feeding fluid to and from the ram 12 are provided on the piston rod 13 near the head piece 14 and in FIG. 3 one of these two connectors is indicated at 41. The working chambers in the cylinder of the ram 12 are connected to these connectors, and thence to the hydraulic supply system, via axial passages 42, 43 in the piston rod 13. The device H is preferably constructed so that the connectors (41) will be located between the pins 23.

Figure 6:
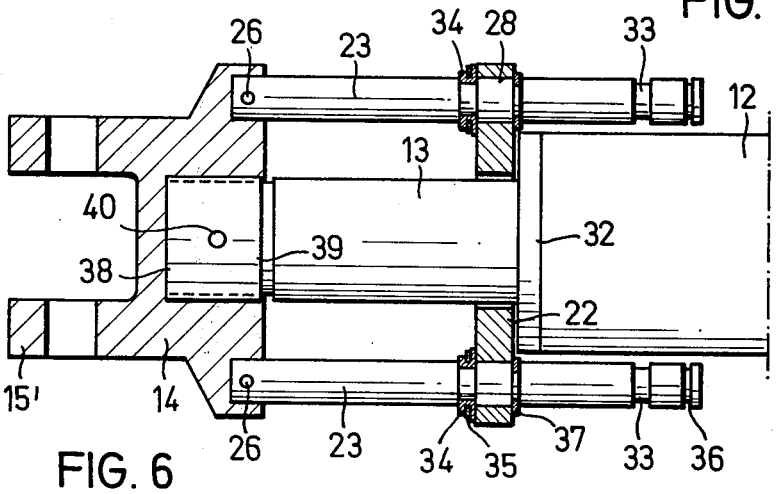
FIG. 6, is a part-sectional plan view of a modified form of device, the view generally corresponding to FIG. 2.

Instead of utilizing bores 24, 28 to receive the pins 23 it is possible to provide open-sided recesses which enable the pins 23 to be inserted and withdrawn laterally. Suitable detachable locking means such as screwed connectors would than be provided to hold the pins 23 in position. FIG. 6, depicts a modified form of the shifting or stroke control device as described and for convenience like reference numerals are used to denote like parts. In contrast to the device shown in FIGS. 2 to 5, the device shown in FIG. 6 enables the distance between the head piece 14 and the stop member 22 to be altered without replacement of the pins 23. As shown in FIG. 6, the pins 23 are provided with annular grooves 33, 36 spaced apart longitudinally of the pins 23. Instead of the clamping pins or sleeves 29 used to secure the stop member 22 to the pins 23 this embodiment of the invention employs locking members 34, 35, 37 which locate in selected grooves 33, 36 in the pins 23 on either side of the stop 22. Each locking member 34 is composed of two half-rings located in an associated groove 33 and secured therein with a securing, e.g. resilient, ring 35. The complementary locking member 37 can take the form of a circle fitted into the narrower groove 36 associated with the groove 33 which is adopted. By releasing the ring 35 the half rings 34 can be removed and the locking element 22 can be positionally adjusted in relation to the pins 23 once the locking member 37 is released.

As also shown in FIG. 6, the head piece 14 is provided with a bifurcated joint 15' instead of the one piece toggle joint 15 shown in FIG. 3. In both cases, however, it is desirable to provide the head piece 14 with a threaded bore 38 which receives a screw threaded end portion 39 of the piston rod 13. A detachable clamping sleeve 40 extends through aligned transverse bores in the end portion 39 and the head piece 14 and thus serves to lock the screw-threaded connection between the head piece 14 and the piston rod 13.

We claim:

1. In or for mineral mining apparatus; the combination of a double-acting hydraulic ram with a relatively-displaceable cylinder component and piston rod, a head piece component fitted to the piston rod to confront the cylinder components, and an adjustable device for selectively limiting the stroke of the ram, said device comprising a stop member disposed between said components, the stop member partly surrounding the piston rod so as not to extend around the full periphery thereof, and connecting means at least including a plurality of elongate pins aligned parallel to the piston rod for connecting the stop member to one of said components so as to abut with the other of said components thereby to limit the stroke of the ram, wherein the pins are located in some of a group of reception apertures in the said one component, said apertures being spaced around a common pitch circle with its centre on the axis of the piston rod, the total number of apertures exceeding the number of pins to permit the stop member to be angularly oriented around the piston rod into a variety of dispositions.

2. A device according to claim 1, wherein the stop member partly surrounds the piston rod over a peripheral region of the latter which corresponds to an angle of 180°–220°.

3. A device according to claim 1 wherein at least part of the connecting means is adjustable to vary the spacing between the confronting components.

4. A device according to claim 1, wherein at least part of the connecting means is interchangeable to vary the spacing between the confronting components.

5. A device according to claim 1 wherein the apertures are provided in the piston rod head piece.

6. A device according to claim 5, wherein the apertures are in the form of bores.

7. A device according to claim 5, wherein the apertures are in the form of open recesses.

8. A device according to claim 1, wherein transverse holes lead to the apertures and the pins have similar transverse holes which can be aligned with the holes in the said one component to receive detachable clamping elements.

9. A device according to claim 1, wherein the pins also locate in bores in the stop member.

10. A device according to claim 1, wherein the pins also locate in open recesses in the stop member.

11. A device according to claim 9, wherein transverse holes lead to the bores in the stop member and the pins have similar transverse holes which can be aligned with the holes in the stop member to receive detachable clamping elements.

12. A device according to claim 1, wherein spaced-apart grooves are provided in the pins and locking members locate in the grooves to secure the stop member to the pins at variable spacings from the said one component.

13. A device according to claim 1, wherein sets of pins of different lengths are provided for connecting the said one component to the stop member at different spacings.

* * * * *